US011368793B1

(12) United States Patent
Yang

(10) Patent No.: US 11,368,793 B1
(45) Date of Patent: Jun. 21, 2022

(54) SPEAKER UNIT WITH DUAL DIAPHRAGMS AND DUAL COILS

(71) Applicant: Bill Yang, Taipei (TW)

(72) Inventor: Bill Yang, Taipei (TW)

(73) Assignee: Cotron Corporation, Taipei (TW)

( * ) Notice: Subject to any disclaimer, the term of this patent is extended or adjusted under 35 U.S.C. 154(b) by 0 days.

(21) Appl. No.: 17/195,651

(22) Filed: Mar. 9, 2021

(30) Foreign Application Priority Data

Jan. 5, 2021 (TW) ..... 110100295

(51) Int. Cl.

| | |
|---|---|
| ***H04R 9/06*** | (2006.01) |
| ***H04R 9/02*** | (2006.01) |
| ***H04R 9/04*** | (2006.01) |
| ***H04R 1/28*** | (2006.01) |
| ***H04R 7/04*** | (2006.01) |

(52) U.S. Cl.
CPC ..... *H04R 9/025* (2013.01); *H04R 1/2811* (2013.01); *H04R 7/04* (2013.01); *H04R 9/045* (2013.01); *H04R 9/06* (2013.01); *H04R 9/063* (2013.01); *H04R 2209/026* (2013.01); *H04R 2209/041* (2013.01)

(58) Field of Classification Search
CPC ..... H04R 1/1008; H04R 1/403; H04R 1/24; H04R 1/26; H04R 7/04; H04R 9/025; H04R 9/045; H04R 9/063; H04R 9/06; H04R 2209/026; H04R 2209/041
See application file for complete search history.

(56) References Cited

U.S. PATENT DOCUMENTS

| | | | | |
|---|---|---|---|---|
| 4,965,836 | A * | 10/1990 | Andre | H04R 1/1008 181/129 |
| 10,873,801 | B1 * | 12/2020 | Hsu | H04R 9/025 |
| 2005/0271236 | A1 * | 12/2005 | Kobayashi | H04R 1/24 381/396 |
| 2016/0314779 | A1 * | 10/2016 | Huang | G10K 11/17875 |

FOREIGN PATENT DOCUMENTS

| | | |
|---|---|---|
| CN | 204929247 | 12/2015 |
| CN | 206042283 | 3/2017 |
| TW | M590338 | 2/2020 |

OTHER PUBLICATIONS

CN204929247 (English translation) (Year: 2015).*
"Office Action of Taiwan Counterpart Application", dated Jun. 17, 2021, p. 1-p. 6.

* cited by examiner

*Primary Examiner* — Huyen D Le
(74) *Attorney, Agent, or Firm* — JCIPRNET

(57) ABSTRACT

A speaker unit with dual diaphragms and dual coils includes a casing, first and second magnetic members, and first and second vibration systems. The casing has a chamber. The first and second magnetic members are disposed in the chamber. The first vibration system includes a first diaphragm fixed on the casing and located in the chamber, and a first coil fixed on the first diaphragm and located beside the first magnetic member. The first diaphragm has a ring shape. An orthogonal projection of the second magnetic member on an inner bottom surface of the casing is completely located in an orthogonal projection of a central opening of the first diaphragm on the inner bottom surface. The second vibration system includes a second diaphragm fixed on the casing and located in the chamber, and a second coil fixed on the second diaphragm and located beside the second magnetic element.

8 Claims, 5 Drawing Sheets

SPEAKER UNIT WITH DUAL DIAPHRAGMS AND DUAL COILS

CROSS-REFERENCE TO RELATED APPLICATION

This application claims the priority benefit of Taiwanese application no. 110100295, filed on Jan. 5, 2021. The entirety of the above-mentioned patent application is hereby incorporated by reference herein and made a part of this specification.

BACKGROUND

Technical Field

The disclosure relates to a speaker unit; in particular, the disclosure relates to a speaker unit with dual diaphragms and dual coils.

Description of Related Art

With continuous technological advancement, personal electronic products are all trending toward being lightweight and miniaturized. Smart phones, tablet computers, notebook computers, or the like have become indispensable in people's daily life. For any of the above-mentioned electronic products, earphones have become necessary accessories for users to listen to audio information provided by the electronic products without disturbing others. Earphones provide better sound transmission to listeners, so that the listeners clearly hear and understand the content of the sound, rather than unclear sound resulting from sound transmission in the air. With earphones, the sound transmission will not be affected especially when the users are moving, for example, during exercise, driving, or intense activities or are in noisy environments. In addition, for making calls with the electronic products, a headset with a microphone is also a common accessory.

Besides, with the technological advancement, wireless earphones that rid the users of wires are also more and more popular with the users. In addition to the use of wireless technology, noise cancelation is also of an important consideration for many users when purchasing earphones. In the current active noise-canceling technology, a microphone configured to collect noise is disposed in the earphones, and the noise collected by the microphone is converted into a digital signal, inverted, mixed with an original audio signal to be played, and then played by a speaker unit in the earphones, so as to offset an environmental noise and achieve noise cancelation. However, the audio mixed with the inverted noise signal is distorted when played through a single speaker unit, resulting in a lowered desire of purchase of the users.

SUMMARY

The disclosure provides a speaker unit, which increases adversely affected sound quality caused by noise cancelation.

According to an embodiment of the disclosure, the speaker unit with dual diaphragms and dual coils includes a casing, a first magnetic element, a first vibration system, a second magnetic element, and a second vibration system. The casing has a chamber. The first magnetic member is disposed in the chamber of the casing. The first vibration system includes a first diaphragm and a first coil. The first diaphragm is fixed on the casing and located in the chamber. The first diaphragm has a ring shape. The first coil is fixed on the first diaphragm and located beside the first magnetic member. The second magnetic member is disposed in the chamber of the casing. An orthogonal projection of the second magnetic member on an inner bottom surface of the casing is completely located in an orthogonal projection of a central opening of the first diaphragm on the inner bottom surface. The second vibration system includes a second diaphragm and a second coil. The second diaphragm is fixed on the casing and located in the chamber. The second coil is fixed on the second diaphragm and located beside the second magnetic element.

In an embodiment of the disclosure, the speaker unit with dual diaphragms and dual coils further includes a microphone. The microphone is disposed in the casing.

In an embodiment of the disclosure, the microphone is disposed on an outer top surface of the casing. The first magnetic element and the second magnetic element are located between the outer top surface and the inner bottom surface.

In an embodiment of the disclosure, the speaker unit with dual diaphragms and dual coils further includes a printed circuit board and a flexible circuit board. The printed circuit board is disposed on an outer bottom surface of the casing. The flexible circuit board is electrically connected to the microphone and the printed circuit board. The inner bottom surface is located between the outer top surface and the outer bottom surface.

In an embodiment of the disclosure, the first magnetic element and the second magnetic element are stacked on the inner bottom surface. The first magnetic element is located between the second magnetic element and the inner bottom surface.

In an embodiment of the disclosure, an inner edge of the first diaphragm is fixed on the first magnetic element. An outer edge of the first diaphragm is fixed on the casing.

In an embodiment of the disclosure, the speaker unit with dual diaphragms and dual coils further includes a separator. The separator is disposed in the chamber of the casing to separate the chamber into a first audio chamber and a second audio chamber. The first diaphragm is located in the first audio chamber. The second diaphragm is located in the second audio chamber.

In an embodiment of the disclosure, the casing also has a first audio hole and a second audio hole. The first audio chamber is connected to an outside through the first audio hole. The second audio chamber is connected to the outside through the second audio hole.

In an embodiment of the disclosure, the speaker unit with dual diaphragms and dual coils further includes a first tuning element and a second tuning element. The first tuning element covers the first audio hole. The second tuning element covers the second audio hole.

In an embodiment of the disclosure, the speaker unit with dual diaphragms and dual coils further includes a driving circuit. The driving circuit includes an audio positive end, an audio negative end, a noise-canceling positive end, a noise-canceling negative end, a microphone positive end, a microphone negative end, and an audio input end. The audio positive end and the audio negative end are electrically connected to the second coil. The noise-canceling positive end and the noise-canceling negative end are electrically connected to the first coil. The microphone positive end and the microphone negative end are electrically connected to the microphone. The audio positive end and the audio negative end are electrically connected to the audio input end. The audio input end is electrically connected to an external audio source. The noise-canceling positive end and the noise-canceling negative end are electrically connected to the microphone.

In an embodiment of the disclosure, the audio positive end and the audio negative end are electrically isolated from the microphone positive end and the microphone negative end. The noise-canceling positive end and the noise-canceling negative end are electrically isolated from the audio input end.

Based on the foregoing, the speaker unit with dual diaphragms and dual coils of the disclosure includes two vibration systems, respectively playing a target audio and an inverted noise audio. Therefore, fidelity of the sound is increased and noise cancelation is achieved.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
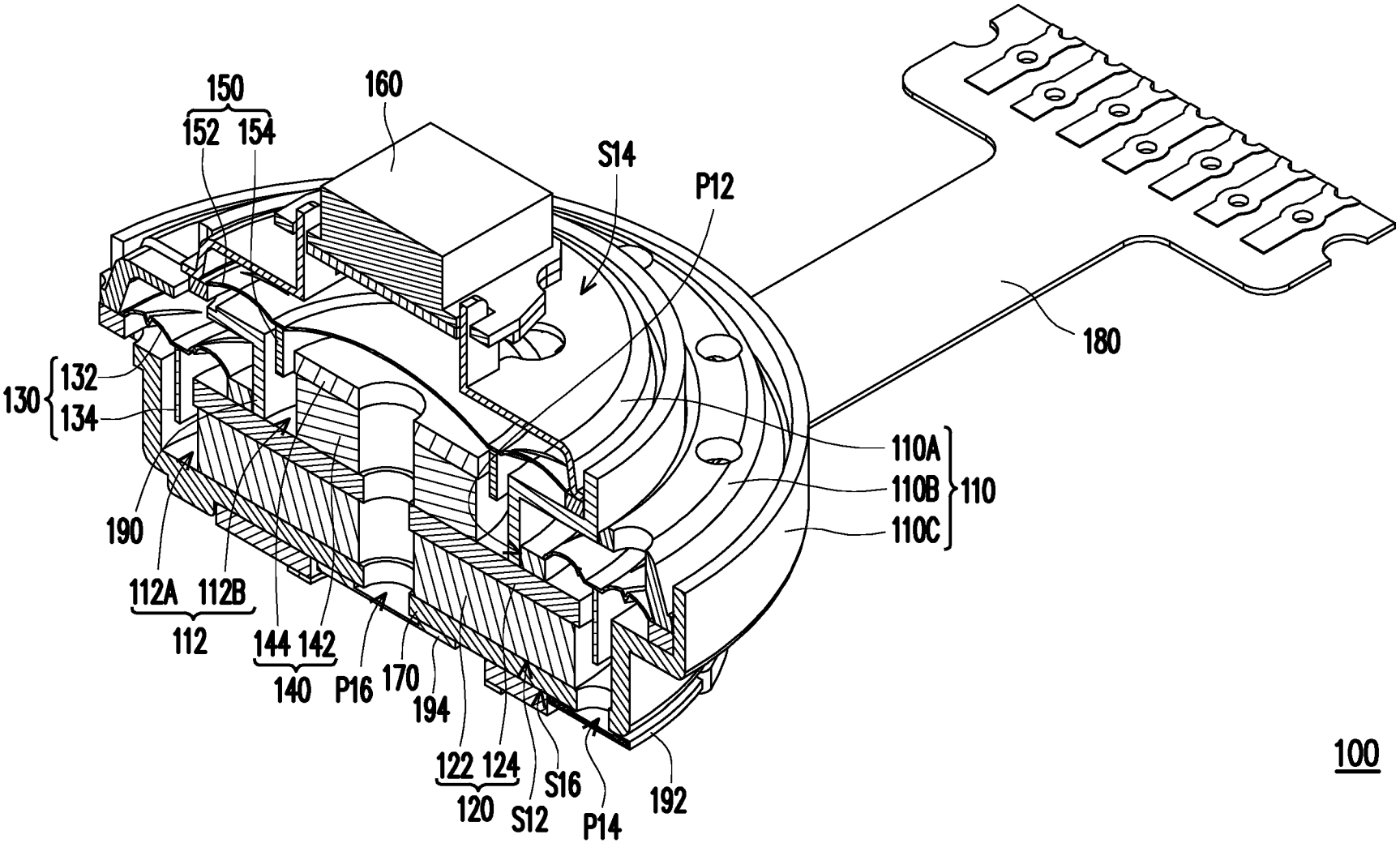
FIG. 1 is a three-dimensional cross-sectional view of a speaker unit with dual diaphragms and dual coils according to an embodiment of the disclosure.

FIG. 1 is a three-dimensional cross-sectional view of a speaker unit with dual diaphragms and dual coils according to an embodiment of the disclosure. With reference to FIG. 1, according to an embodiment of the disclosure, a speaker unit with dual diaphragms and dual coils 100 includes a casing 110, a first magnetic element 120, a first vibration system 130, a second magnetic element 140, and a second vibration system 150. The casing 110 has a chamber 112. The first magnetic element 120 is disposed in the chamber 112 of the casing 110. The first vibration system 130 includes a first diaphragm 132 and a first coil 134. The first diaphragm 132 is fixed on the casing 110 and located in the chamber 112. The first diaphragm 132 has a ring shape. The first coil 134 is fixed on the first diaphragm 132 and located beside the first magnetic element 120. That is, through the cooperation between the first coil 134 and the first magnetic element 120, the first coil 134 drives the first diaphragm 132 to vibrate and emit a sound.

The second magnetic element 140 is disposed in the chamber 112 of the casing 110. An orthogonal projection of the second magnetic element 140 on an inner bottom surface S12 of the casing 110 is completely located in an orthogonal projection of a central opening P12 of the first diaphragm 132 on the inner bottom surface S12. That is, in a top view of FIG. 1, the second magnetic element 140 is completely located in the central opening P12 of the first diaphragm 132. Besides, in a side view of FIG. 1, the second magnetic element 140 of the embodiment penetrates the central opening P12 of the first diaphragm 132. In other embodiments, it is also possible that the second magnetic element does not penetrate the central opening of the first diaphragm, which is not limited by the disclosure.

The second vibration system 150 includes a second diaphragm 152 and a second coil 154. The second diaphragm 152 is fixed on the casing 110 and located in the chamber 112. The second coil 154 is fixed on the second diaphragm 152 and located beside the second magnetic element 140. That is, through the cooperation between the second coil 154 and the second magnetic element 140, the second coil 154 drives the second diaphragm 152 to vibrate and emit a sound.

In this embodiment, the first diaphragm 132 and the second diaphragm 152 independent of each other are included, which may respectively play audios from different sources. For example, the first diaphragm 132*a* may play a noise audio obtained from an environmental noise being converted into a digital signal and inverted. On the other hand, the second diaphragm 152 may play a target audio input from an external audio source, such as music, voice content, and the like. Therefore, the second diaphragm 152 plays the audio input from the external audio source with high fidelity, and the inverted noise audio played by the first diaphragm 132 also offsets the environmental noise to achieve noise cancelation.

Besides, since the noise sensible by a user is mainly in a low frequency portion, thus noise cancelation is achieved as long as the low-frequency noise is offset. When the inverted noise audio is played with the first diaphragm 132, noise cancelation is not much affected even though a frequency response of the first diaphragm 132 is lower in a high frequency portion due to the presence of the central opening P12. In addition, since the central opening P12 accommodates the second magnetic element 140, the size of the speaker unit with dual diaphragms and dual coils 100 will not be greatly increased due to the two diaphragms and the two magnetic elements.

Figure 2:
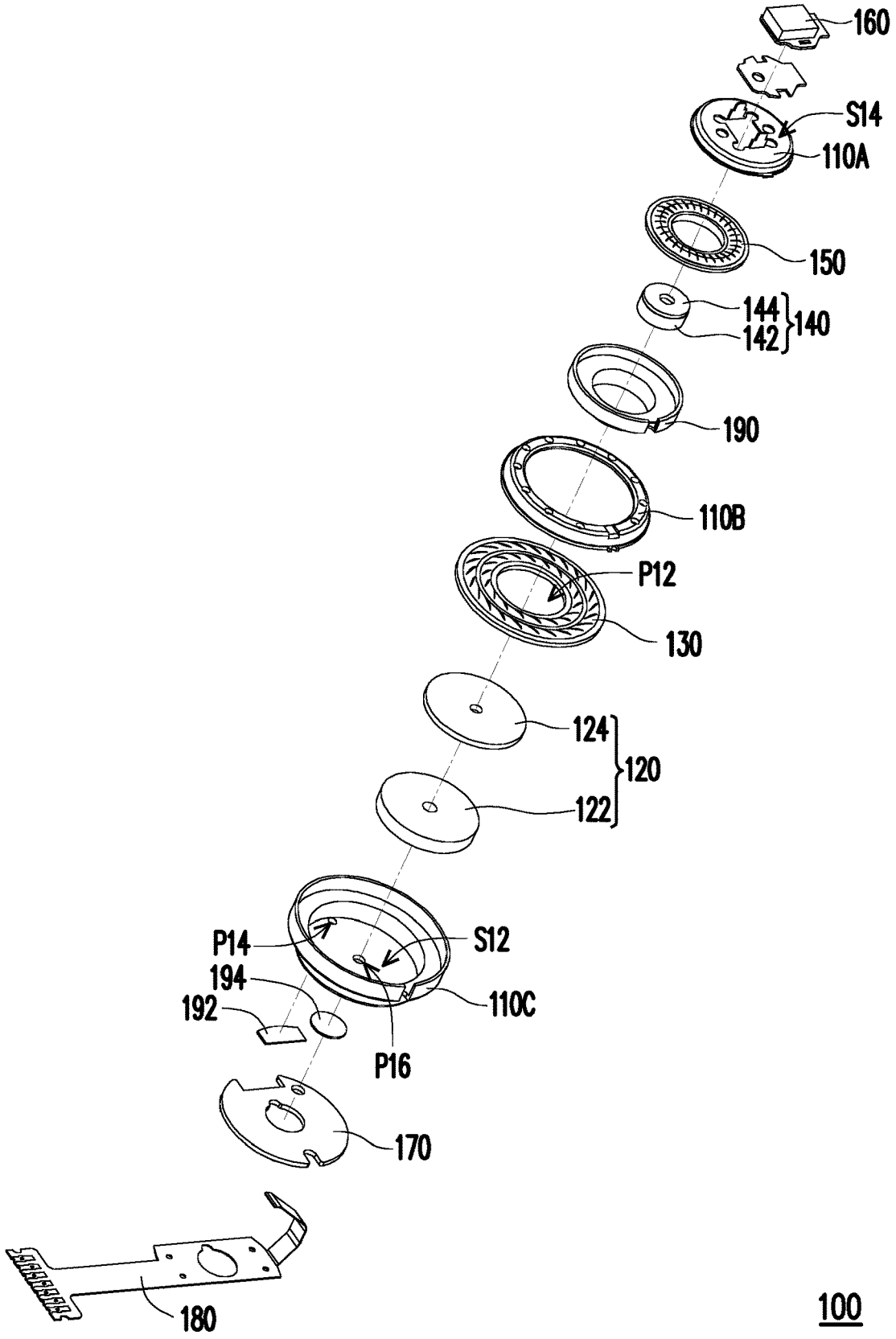
FIG. 2 is an exploded view of the speaker unit with dual diaphragms and dual coils of FIG. 1.

FIG. 2 is an exploded view of the speaker unit with dual diaphragms and dual coils of FIG. 1. With reference to FIG. 1 and FIG. 2, in this embodiment, the speaker unit with dual diaphragms and dual coils 100 further includes a microphone 160 disposed on the casing 110. For example, the microphone 160 may collect the environmental noise. After the environmental noise collected by the microphone 160 is converted into a digital signal and inverted, the obtained noise audio may be played by the first diaphragm 132. The microphone 160 of this embodiment is disposed on an outer top surface S14 of the casing 110. The first magnetic element 120 and the second magnetic element 140 are located between the outer top surface S14 and the inner bottom surface S12. For example, the casing 110 includes a first element 110A. The first element 110A has the outer top surface S14, and the microphone 160 is disposed on the outer top surface S14 of the first element 110A. The first element 110A, for example, has a hole for the sound emitted by the second diaphragm 152 to pass through and be transmitted to an eardrum of the user. Besides, the first element 110A may provide a supporting structure for the microphone 160 to be elevated above the outer top surface S14 to prevent the microphone 160 from covering the hole.

Figure 3:
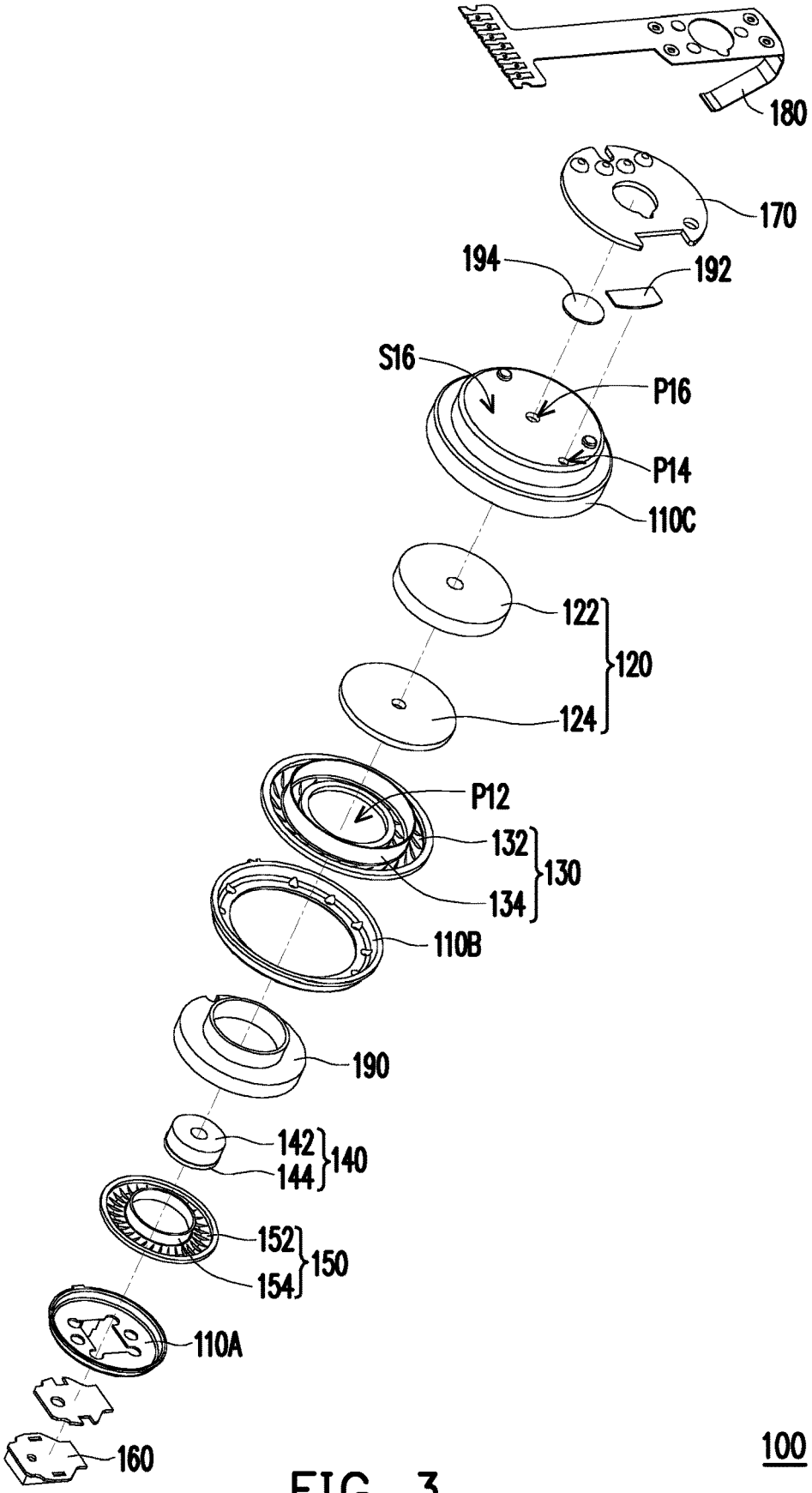
FIG. 3 is an exploded view of the speaker unit with dual diaphragms and dual coils of FIG. 1 from another view angle.

FIG. 3 is an exploded view of the speaker unit with dual diaphragms and dual coils of FIG. 1 from another view angle. With reference to FIG. 1 to FIG. 3, in this embodiment, the speaker unit with dual diaphragms and dual coils 100 further includes a printed circuit board 170 and a flexible circuit board 180. The printed circuit board 170 is disposed on an outer bottom surface S16 of the casing 110. For example, the casing 110 also includes a third element 110C. The third element 110C has the outer bottom surface S16, and the printed circuit board 170 is disposed on the outer bottom surface S16 of the third element 110C. The flexible circuit board 180 is electrically connected to the microphone 160 and the printed circuit board 170. The inner bottom surface S12 is located between the outer top surface S14 and the outer bottom surface S16. In other words, the microphone 160 and the printed circuit board 170 are respectively located on upper and lower sides of the casing 110. Therefore, when the speaker unit with dual diaphragms and dual coils 100 is applied to an earphone worn in an ear canal of the user, the microphone 160 is closer to the eardrum of the user than other components, and further collects noise received closer to the eardrum of the user, increasing noise cancelation. The flexible circuit board 180 may transmit signals between the printed circuit board 170 and the microphone 160, and the flexible circuit board 180 may also transmit signals between the printed circuit board 170 and external elements.

In this embodiment, the first magnetic element 120 and the second magnetic element 140 are stacked on the inner bottom surface S12. The first magnetic element 120 is located between the second magnetic element 140 and the inner bottom surface S12. With such an architecture, space required for disposing the first magnetic element 120 and the second magnetic element 140 may be saved, such that the speaker unit with dual diaphragms and dual coils 100 has a compact size. The first magnetic element 120 of the embodiment includes, for example, a permanent magnetic element 122 and a magnetic induction element 124, and the magnetic induction element 124 is located between the permanent magnetic element 122 and the first diaphragm 132. The second magnetic element 140 of this embodiment includes, for example, a permanent magnetic element 142 and a magnetic induction element 144, and the magnetic induction element 144 is located between the permanent magnetic element 142 and the second diaphragm 152.

In this embodiment, an inner edge of the first diaphragm 132 is fixed on the first magnetic element 120. An outer edge of the first diaphragm 132 is fixed on the casing 110. The inner edge of the first diaphragm 132 is namely an edge of the central opening P12. For example, the inner edge and the outer edge of the first diaphragm 132 respectively have fixing rings, and the two fixing rings are respectively fixed on the first magnetic element 120 and the casing 110. With the fixing rings, the first diaphragm 132 is ensured to be less susceptible to deformation and damage.

In this embodiment, the speaker unit with dual diaphragms and dual coils 100 further includes a separator 190, which is disposed in the chamber 112 of the casing 110 to separate the chamber 112 into a first audio chamber 112A and a second audio chamber 112B. The first diaphragm 132 is located in the first audio chamber 112A. The second diaphragm 152 is located in the second audio chamber 112B. For example, the separator 190 is disposed on the first magnetic element 120. The casing 110 also includes a second element 110B. The separator 190, the second element 110B, the third element 110C, and the first magnetic element 120 together define the first audio chamber 112A. The separator 190 and the second element 110B are both located above the first diaphragm 132. The second element 110B, for example, has a hole for the sound emitted by the first diaphragm 132 to pass through and be transmitted to the eardrum of the user.

In this embodiment, the casing 110 also has a first audio hole P14 and a second audio hole P16. The first audio chamber 112A is connected to the outside through the first audio hole P14. The second audio chamber 112B is connected to the outside through the second audio hole P16. Specifically, the first audio hole P14 and the second audio hole P16 are respectively located behind the first diaphragm 132 and the second diaphragm 152, so that air can pass through when the first diaphragm 132 and the second diaphragm 152 are vibrating, preventing influences on vibration of the first diaphragm 132 and the second diaphragm 152. The first audio hole P14 of this embodiment is located on the third element 110C, for example. The second audio hole P16 of this embodiment, for example, passes through the first magnetic element 120, the second magnetic element 140, and the third element 110C.

In this embodiment, the speaker unit with dual diaphragms and dual coils 100 further includes a first tuning element 192 and a second tuning element 194. The first tuning element 192 covers the first audio hole P14. The second tuning element 194 covers the second audio hole P16. The materials of the first tuning element 192 and the second tuning element 194 includes, for example, nonwoven fabric or other appropriate materials.

Figure 4:
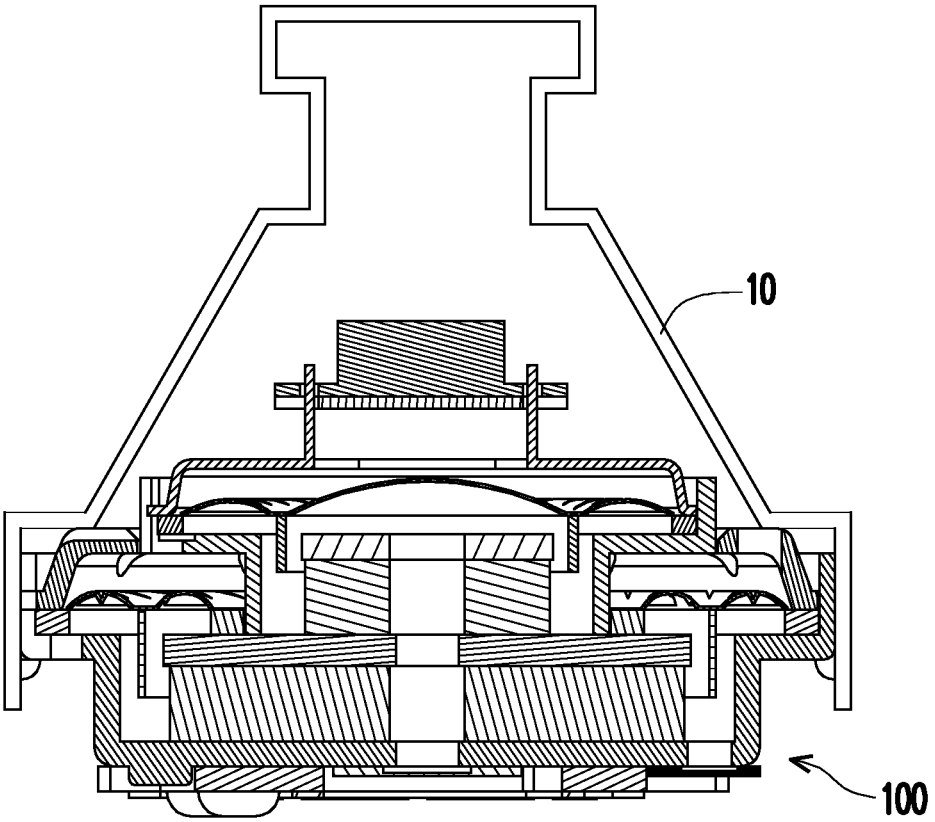
FIG. 4 is a schematic cross-sectional view of the speaker unit with dual diaphragms and dual coils of FIG. 1 being applied to an earphone.

FIG. 4 is a schematic cross-sectional view of the speaker unit with dual diaphragms and dual coils of FIG. 1 being applied to an earphone. With reference to FIG. 1 and FIG. 4, when applied to an earphone, the speaker unit with dual diaphragms and dual coils 100 of this embodiment may be mounted in a molded casing 10. The speaker unit with dual diaphragms and dual coils 100 and the molded casing 10 may be assembled through dispensing a glue at the junction between the two. The appearance of the molded casing 10 may vary depending on design requirements, and an ear pad (not shown) may be mounted on one side of the molded casing 10 for comfort in use.

Figure 5:
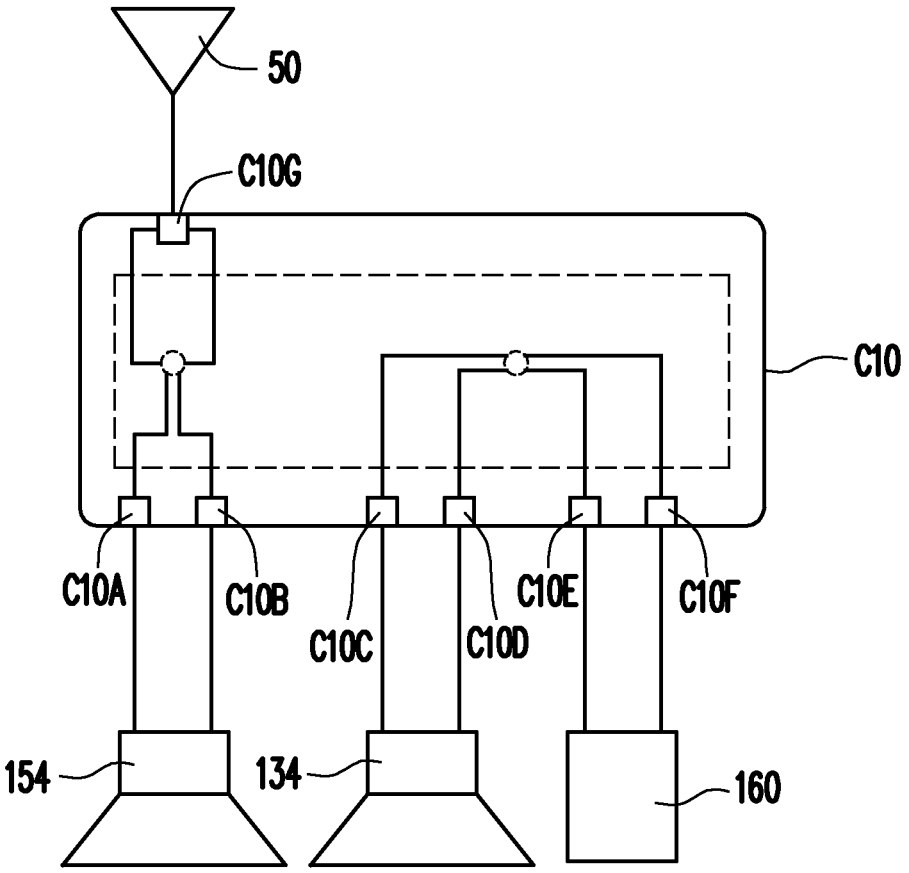
FIG. 5 is a schematic block diagram of the speaker unit with dual diaphragms and dual coils of FIG. 1.

FIG. 5 is a schematic block diagram of the speaker unit with dual diaphragms and dual coils of FIG. 1. With reference to FIG. 1 and FIG. 5, in this embodiment, the speaker unit with dual diaphragms and dual coils 100 also includes a driving circuit C10. For example, the driving circuit C10 may be fabricated on the printed circuit board 170 and the flexible circuit board 180. The driving circuit C10 includes an audio positive end C10A, an audio negative end C10B, a noise-canceling positive end C10C, a noise-canceling negative end C10D, a microphone positive end C10E, a microphone negative end C10F, and an audio input end C10G. The audio positive end C10A and the audio negative end C10B are electrically connected to the second coil 154. The noise-canceling positive end C10C and the noise-canceling negative end C10D are electrically connected to the first coil 134. The microphone positive end C10E and the microphone negative end C10F are electrically connected to the microphone 160. The audio positive end C10A and the audio negative end C10B are electrically connected to the audio input end C10G. The audio input end C10G is electrically connected to an external audio source 50. The noise-canceling positive end C10C and the noise-canceling negative end C10D are electrically connected to the microphone 160.

The target audio provided by the external audio source 50 may be transmitted through the driving circuit C10 to the second coil 154 to thereby drive the second diaphragm 152 to vibrate and emit a sound. The environmental noise collected by the microphone 160 may be converted into a digital signal and inverted by the driving circuit C10. Then, the obtained noise audio is transmitted to the first coil 134 to thereby drive the first diaphragm 132 to vibrate and emit a sound.

In this embodiment, the audio positive end C10A and the audio negative end C10B are electrically isolated from the microphone positive end C10E and the microphone negative end C10F. The noise-canceling positive end C10C and the noise-canceling negative end C10D are electrically isolated from the audio input end C10G. That is, the target audio provided by the external audio source 50 will not be transmitted to the first coil 134 to be emitted by the first diaphragm 132 through vibration. In addition, after the environmental noise collected by the microphone 160 is inverted, the obtained noise audio will not be transmitted to the second coil 154 to be emitted by the second diaphragm 152 through vibration. Therefore, interference is prevented between the two.

In summary of the foregoing, in the speaker unit with dual diaphragms and dual coils of the disclosure, the two vibration systems respectively play different audios. For example, one vibration system plays the target audio, and another vibration system plays the inverted noise audio. Therefore, the user can listen to the target audio with high fidelity when the environmental noise is offset by the inverted noise audio to achieve noise cancelation.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A speaker unit with dual diaphragms and dual coils, comprising:

a casing having a chamber;

a first magnetic element disposed in the chamber of the casing;

a first vibration system comprising a first diaphragm and a first coil, wherein the first diaphragm is fixed on the casing and located in the chamber, the first diaphragm has a ring shape, and the first coil is fixed on the first diaphragm and located beside the first magnetic element;

a second magnetic element disposed in the chamber of the casing, wherein an orthogonal projection of the second magnetic element on an inner bottom surface of the casing is completely located in an orthogonal projection of a central opening of the first diaphragm on the inner bottom surface;

a second vibration system comprising a second diaphragm and a second coil, wherein the second diaphragm is fixed on the casing and located in the chamber, and the second coil is fixed on the second diaphragm and located beside the second magnetic element;

a microphone disposed in the casing, wherein the microphone is disposed on an outer top surface of the casing, and the first magnetic element and the second magnetic element are located between the outer top surface and the inner bottom surface; and a printed circuit board and a flexible circuit board, wherein the printed circuit board is disposed on an outer bottom surface of the casing, the flexible circuit board is electrically connected to the microphone and the printed circuit board, and the inner bottom surface is located between the outer top surface and the outer bottom surface.

2. The speaker unit with dual diaphragms and dual coils according to claim 1, wherein the first magnetic element and the second magnetic element are stacked on the inner bottom surface, and the first magnetic element is located between the second magnetic element and the inner bottom surface.

3. The speaker unit with dual diaphragms and dual coils according to claim 1, wherein an inner edge of the first diaphragm is fixed on the first magnetic element, and an outer edge of the first diaphragm is fixed on the casing.

4. The speaker unit with dual diaphragms and dual coils according to claim 1, further comprising a separator disposed in the chamber of the casing to separate the chamber into a first audio chamber and a second audio chamber, wherein the first diaphragm is located in the first audio chamber, and the second diaphragm is located in the second audio chamber.

5. The speaker unit with dual diaphragms and dual coils according to claim 4, wherein the casing further has a first audio hole and a second audio hole, the first audio chamber is connected to an outside through the first audio hole, and the second audio chamber is connected to the outside through the second audio hole.

6. The speaker unit with dual diaphragms and dual coils according to claim 5, further comprising a first tuning element and a second tuning element, wherein the first tuning element covers the first audio hole and the second tuning element covers the second audio hole.

7. A speaker unit with dual diaphragms and dual coils, comprising:

a casing having a chamber;

a first magnetic element disposed in the chamber of the casing;

a first vibration system comprising a first diaphragm and a first coil, wherein the first diaphragm is fixed on the casing and located in the chamber, the first diaphragm has a ring shape, and the first coil is fixed on the first diaphragm and located beside the first magnetic element;

a second magnetic element disposed in the chamber of the casing, wherein an orthogonal projection of the second magnetic element on an inner bottom surface of the casing is completely located in an orthogonal projection of a central opening of the first diaphragm on the inner bottom surface;

a second vibration system comprising a second diaphragm and a second coil, wherein the second diaphragm is fixed on the casing and located in the chamber, and the second coil is fixed on the second diaphragm and located beside the second magnetic element;

a microphone disposed in the casing; and a driving circuit, wherein the driving circuit comprises an audio positive end, an audio negative end, a noise-canceling positive end, a noise-canceling negative end, a microphone positive end, a microphone negative end, and an audio input end, wherein the audio positive end and the audio negative end are electrically connected to the second coil, the noise-canceling positive end and the noise-canceling negative end are electrically connected to the first coil, the microphone positive end and the microphone negative end are electrically connected to the microphone, the audio positive end and the audio negative end are electrically connected to the audio input end, the audio input end is electrically connected to an external audio source, and the noise-canceling positive end and the noise-canceling negative end are electrically connected to the microphone.

8. The speaker unit with dual diaphragms and dual coils according to claim 7, wherein the audio positive end and the audio negative end are electrically isolated from the microphone positive end and the microphone negative end, and the noise-canceling positive end and the noise-canceling negative end are electrically isolated from the audio input end.

* * * * *